US006853140B2

(12) United States Patent
Lapatovich et al.

(10) Patent No.: US 6,853,140 B2
(45) Date of Patent: Feb. 8, 2005

(54) MERCURY FREE DISCHARGE LAMP WITH ZINC IODIDE

(75) Inventors: Walter P. Lapatovich, Boxford, MA (US); Sharon L. Ernest, Hooksett, NH (US); Susan L. Callahan, Peterborough, NH (US); Robert J. Karlotski, deceased, late of Manchester, NH (US); by Janice T. Karlotski, legal representative, Manchester, NH (US)

(73) Assignee: Osram Sylvania Inc., Danvers, MA (US)

( * ) Notice: Subject to any disclaimer, the term of this patent is extended or adjusted under 35 U.S.C. 154(b) by 15 days.

(21) Appl. No.: 10/242,228

(22) Filed: Sep. 12, 2002

(65) Prior Publication Data

US 2003/0189408 A1 Oct. 9, 2003

Related U.S. Application Data

(60) Provisional application No. 60/369,731, filed on Apr. 4, 2002.

(51) Int. Cl.[7] ..... H01J 17/20; H01J 61/12; H01J 61/18

(52) U.S. Cl. ..... 313/637; 313/636; 313/638; 313/643

(58) Field of Search ..... 313/637, 638

(56) References Cited

U.S. PATENT DOCUMENTS 5,973,453 A * 10/1999 Van Vliet et al. ..... 313/623
6,137,230 A * 10/2000 Born et al. ..... 313/638
6,495,962 B2 * 12/2002 Uemura et al. ..... 315/77
6,528,946 B2 * 3/2003 Ishigami et al. ..... 313/637

* cited by examiner

*Primary Examiner*—Joseph Williams
*Assistant Examiner*—Matt Hodges
(74) *Attorney, Agent, or Firm*—William E. Meyer

(57) ABSTRACT

A compact fused silica, electroded HID lamp for automotive forward lighting, which contains no mercury. The lamps voltage, approximately 40 volts, is developed in this lamp by vaporizing zinc iodide instead of mercury. A compromise between voltage and luminous flux is achieved through the choice of the sodium scandium (Na:Sc) molar ratio, between 4.5:1 and 6:1 and a zinc iodide ($ZnI_2$) dose of 2 to 6 micrograms per cubic millimeter that permits the lamp to operate within the North America, European and Japanese automotive color specifications for white light. The voltage in the lamp can be controlled according to the zinc iodide doping level without seriously impacting the visible spectrum otherwise provided by the other known dopants in the lamp.

7 Claims, 6 Drawing Sheets

MERCURY FREE DISCHARGE LAMP WITH ZINC IODIDE

The Applicants hereby claim the benefit of their provisional application, Ser. No. 60/369,731 filed Apr. 4, 2002 for Mercury Free Discharge Lamp With Zinc Iodide.

BACKGROUND OF THE INVENTION

The present invention is directed to an electric lamp, and more particularly to a discharge lamp that is free of mercury and that contains a zinc iodide dopant.

Government agencies and the automotive industry have acknowledged concerns with automotive mercury use since the early 1990's. In 1995 it was determined that mercury switches were responsible for more than 99% of the mercury in automobiles—primarily in hood and trunk lighting, but also in antilock braking systems, *Toxics in Vehicles: Mercury, A report by the Ecology Center*, Great Lakes United, University of Tennessee Center for Clean Products and Clean Technologies, January 2001. As a result, the automakers agreed to voluntarily phase out mercury switches within a few years and to educate auto recyclers how to remove switches from existing vehicles. While the use of mercury in convenience lighting switches has significantly declined since 1996, mercury use for ABS applications appears to have at least doubled and possibly tripled. Other uses of mercury in automobiles, such as high intensity discharge headlamps, navigational displays and family entertainment systems, also appear to be on the rise.

High Intensity Discharge (HID) headlamps are an emerging application for mercury in automobiles. These headlamps offer improved visibility, longer life, and use less energy than standard tungsten halogen headlamps. Each HID light source contains approximately 0.5 mg of mercury and passes the Federal TCLP test for hazardous waste. The European Union (EU) ELV (end-of life vehicles) directive exempts mercury-containing bulbs from its ban on mercury in vehicles. The use of HID headlamps is expected to increase as introduction on less expensive, higher volume models continues.

It is reasonable to ask why mercury is present in an automotive HID lamp. Mercury does not significantly contribute to the visible spectrum during steady state operation since its lowest excitation levels are higher in energy than the ionization potential of the metal halide additives added to produce white light. Mercury is not essential to the operation of the halogen cycle except as a sequestering agent for excess iodine, which is always formed by chemical reaction within the lamp. The mercuric iodide resulting in the lamp is largely transparent to visible light. There are, however, several additional functions of mercury that make it extremely useful.

Mercury vapor determines the electrical resistance of the arc and is a thermal insulator around the constricted arc channel. The efficient operation of HID lamps with relatively high-pressure metal vapor requires a high total pressure filling to prevent rapid diffusion of dissociated metal and iodine atoms from the arc core to the tube wall. If dissociation took place primarily in the arc core and recombination took place primarily at the wall, the loss of energy due to the dissociation process would be very high, resulting in an inefficient lamp. Mercury is a convenient way of achieving a high total pressure for operation while still having a low pressure at ignition, so that reasonable starting voltages can be obtained.

If any free iodine vapor is present in the lamp at ignition, starting voltages are very high because the strong electron-attaching properties of iodine ($I_2$) interfere with the Townsend avalanche formation, and the vapor pressure of iodine ($I_2$) is relatively high at ambient conditions (0.4 Torr), W. P. Lapatovich and A. B. Budinger, *Winkout in HID Discharges*, Paper O1I4, IEEE Conference Record-Abstracts, 28$^{th}$ Conference on Plasma Science, PPPS-2001, Jun. 17–22, 2000, Las Vegas, Nev. The presence of mercury in excess then ensures that only mercury iodide ($HgI_2$) is present at starting. Although mercury iodide ($HgI_2$) is also an electron-attaching gas, its vapor pressure is substantially lower ($<10^{-3}$ Torr) and causes only a moderate increase in starting voltage.

The advantages of mercury—a large potential gradient of the positive column, relatively low heat loss, low vapor pressure at ambient conditions and relatively low cost—precluded the search for other materials that would provide appropriate buffer gases for automotive HID lamps. Simply removing the mercury is inappropriate because the electrical and thermal conductivities of the arc must be controlled. The ideal replacement for mercury would have a large momentum cross-section, a high neutral particle density at temperature and high excitation and ionization energies.

The first two of these goals for a mercury replacement address the need to limit the discharge current at a given lamp power by increasing the resistance of the plasma sufficiently. Large excitation and ionization energies are required since the replacement should not dominate the visible spectrum significantly, that is, only transitions between high lying energy levels are possible. In addition to these physical properties, the chemical stability of the metal halide salts, electrodes and the quartz walls must be guaranteed for a few thousand hours. Finally, the replacement should be environmentally friendly.

Currently, the EU and the Japanese Electrical Lighting Manufacturers Association (JELMA) are considering amending Regulation 99 to include automotive mercury free HID lamps. The proposed EU and JELMA specifications for automotive mercury type "R-type" HID light sources, D1R, D2R, had the following proposed characteristics: rated voltage of the ballast 12 volts, rated wattage 35 watts; objective lamp voltage 85 volts, +/−17 volts; lamp wattage 35 watts +/−3 watts; luminous flux 2800 lumens +/−450 lumens; color coordinates ($x=0.375$, $y=0.375$) with a tolerance of ($x \geqq 0.345$, $y \leqq 0.150+0.640x$) and ($x \geqq 0.405$, $y \leqq 0.050+0.750x$). The corresponding mercury free D3R and D4R lamps were the same in each instance, except the objective lamp voltage was 42 volts +/−9 volts. The proposed EU and JELMA specifications for automotive mercury type "S-type" HID light sources, D1S, D2S, were the same in each instance as the D1R and D2R lamps, except the luminous flux was to be 3200 lumens. The corresponding mercury free lamps, D3S, D4S were the same in each instance as the D3R and D4R lamps, (lamp voltages 42 volts +/−9 volts) except the luminous flux also was to be 3200 lumens. As can be seen, the proposed performance requirements for the mercury free lamps, except for operating voltages, are identical to the mercury containing lamps. The requirement that the arc bending and diffusion be the same may significantly limit the choices of voltage increasing chemistries. The other differences between the D1/D2 (mercury containing) and D3/D4 (mercury free) lamps are an increase from <0.3 millimeter to <0.4 millimeter in electrode diameter (to allow for higher currents) and the keying of the bases to insure the light sources are not interchangeable.

Screening tools for potential mercury replacements are known. It has been asserted that the inclusion of a metal halide whose ionization potential ($V_i$) is between 5 and 10 eV and whose vapor pressure is at least $10^{-5}$ atmospheres at the lamp operating temperature will sufficiently raise the operating voltage of an automotive HID lamp without significantly increasing the rare gas pressure, K. Takahashi, M. Horiuchi, M. Takeda, T. Saito and H. Kiryu, U.S. Pat. No. 6,265,827 (2001). It is further asserted that electrode losses are reduced and the blackening of the arc tube due to electrode sputtering is suppressed. If the metal halide additive has an ionization potential <5 eV, the operating voltage of the lamp decreases; if the ionization potential is >10 eV, the lamp efficacy decreases; if the vapor pressure at the operating temperature is $>10^{-5}$ atmospheres, an increase in the operating voltage is not observed.

One place to look for mercury replacements is in the same periodic family: cadmium and zinc. Cadmium is not a viable candidate since it is toxic and is being phased out of vehicle lighting, for example, amber turn signal lamps. The life of the lamps containing zinc will decrease because of the vigorous attack on the quartz at the higher operating temperatures required to obtain a sufficiently high vapor pressure (particle density). Work in higher wattage ceramic metal halide lamps suggests a reduction in efficacy of about 8%, a reduction in lamp operating voltage of 25% with a lower arc core temperature, and higher wall temperature when zinc is substituted for mercury, M. Born, *Mercury-Free High Pressure Discharge Lamps*, Paper 002:L, $9^{th}$ International Symposium on the Science and Technology of Light Sources, Cornell University, Ithaca, N.Y., Aug. 12–16, 2001. In addition, the strong affinity of zinc for iodine effectively scavenges iodine from the metal halides, reducing them to elemental metals, M. Born and U. Niemann, Interaction of zinc with Rare Earth Halides Under Conditions of High Pressure Discharge Lamps, $10^{th}$ International IUPAC Conf. on High Temp. Materials Chemistry, Apr. 10–14, 2000, Forschungzentrum, Julich, Germany. The lifetime of lamps at elevated temperature in the presence of aggressive metals (scandium or rare earths) is not expected to be sufficiently long for automotive applications.

Another place to look for a replacement is in the metal halides. Generally, the choices fall into two broad categories: additives that constrict the arc and additives that fatten the arc. The quality and stability of the arc in automotive HID lamps is more critical than in normal metal halide lamps. The automotive HID lamp is an optical source with strict requirements for arc position, arc bending and arc diffusion. Arc constricting chemistries have the advantage of tending to increase the lamp operating voltage. However, in constricted arcs convection carries the arc upward toward the top of the arc tube where severe localized heating can occur and very constricted arcs tend to be unstable. Thorium iodide ($ThI_4$) and excess iodine ($I_2$) have historically yielded constricted arcs. Many of the spectrally rich metals yield lamps with poorly wall-stabilized arcs. The poor quality of these arcs results from the metal having many energy levels, a number of which are quite low-lying, so that the average excitation potential is quite low relative to the ionization potential ($V_{avg}<V_i/2$). Alkali metal iodides are typical of arc fattening additives. Alkali metals have a low ionization potential and this has the effect of making electrons available in low-temperature regions of the arc. The presence of these electrons allows for electrical current flow, which in turn leads to power dissipation and more heat generation in these regions. The net effect is to raise the temperature locally and increase the diameters of the high-temperature region of the arc and of the electrically conducting region. As a result, the arc current for a given wattage increases and the operating voltage decreases. The addition of alkali to the quartz arc tube is possible only as iodides because the metals would react vigorously with the wall at the lamp operating temperatures.

The addition of gallium, indium and thallium iodides alone or in combination does not, in general, result in constricted arcs. The energy levels of these metals are more like those of mercury in that there are relatively few of them and most of them are of energy greater than or equal to half the ionization potential. This would predict wall-stabilized arcs, and also hold the promise of voltage enhancement.

It is possible to use these higher vapor pressure additives in combination with rare earth halides to produce chemical complexes within the lamp. The chemical complexing increases the number density of the radiating species, provides some buffering against wall reactions, and could also enhance the voltage drop across the column, W. P. Lapatovich and J. A. Baglio, Chemical Complexing and Effects on Metal Halide Lamp Performance, Paper 026:I, $9^{th}$ International Symposium on the Science and Technology of Light Sources, Cornell University, Ithaca, N.Y., Aug. 12–16, 2001. The result would be a rare earth complex chemistry, for example, $DyI_3$ with InI. However, the addition of complexing agents can have unintended consequences such as a shift in color coordinates as seen in FIG. 1. FIG. 1 shows the effect of metal iodides on the color coordinates (CCX, CCY) of a mercury free, rare earth chemistry. the ploygon repersents the boundary of the SAE white region.

Considerable effort has been expended in recent years to produce mercury free lamps that operate at high voltages so they can be used as retrofits with existing ballasts. Examples of art where high doses of metal additives are used to elevate the voltage are taught by Ishigami et al. in EP 0 883 160 A1, by Takeda et al. in EP 1 032 010 A1 and Uemura et al. in EP 1 150 337 A1. Examples of other voltage enhancing additives are taught by Takahashi et al. in EP 1 172 839 A2, and by Takahashi et al. in U.S. Pat. No. 6,265,827. Examples of high efficacy fills of a corrosive or toxic nature are taught by Kaneko et al. in EP 1 172 840 A2.

The use of zinc iodide in discharge lamps is known. See, for example, U.S. Pat. Nos. 4,766,348; 5,013,968; 4,992,700; 4,678,960; and 4,360,758. However, there is no suggestion in these references to use a particular amount of zinc iodide as a substitute for mercury in the lamp.

SUMMARY OF THE INVENTION

An object of the present invention is to provide a novel mercury free discharge lamp in which zinc iodide is substituted for mercury.

A further object of the present invention is to provide a novel mercury free discharge lamp for automotive use in which zinc iodide in the amount of 2 to 6 micrograms per cubic millimeter of enclosed volume is substituted for mercury.

These and other objects of the present invention are achieved with a discharge lamp made from fused silica that has the following components:

a light transmissive quartz envelope defining an enclosed volume of between 18 to 42 cubic millimeters;

a first tungsten electrode extending through the envelope in a sealed fashion to contact the enclosed volume;

a second tungsten electrode extending through the envelope in a sealed fashion to contact the enclosed volume, where the tungsten electrode diameters are between 0.20 to 0.40 millimeter; and a fill material positioned in the enclosed volume, where the fill material includes zinc iodide; sodium iodide; scandium iodide, and an inert fill gas, but does not include mercury or mercury compounds;

where the zinc iodide has a concentration in the enclosed volume ranging from 2 to 6 micrograms per cubic millimeter, with 3 to 4 micrograms per cubic millimeter being preferred;

where the sodium iodide has a concentration in the enclosed volume ranging from 5.0 to 5.7 micrograms per cubic millimeter;

where the scandium iodide has a concentration in the enclosed volume ranging from 2.7 to 3.3 micrograms per cubic millimeter; and where the inert fill gas (preferably xenon) has a cold (ambient) fill pressure in the enclosed volume ranging from 0.6 to 1.22 megapascals.

DESCRIPTION OF PREFERRED EMBODIMENTS

The present invention uses zinc iodide ($ZnI_2$) for voltage enhancing additives in specific amounts.

Based on the inventors' experiments, and the compromises which must be made in selecting environmentally friendly fills, the present invention is prescribed to be a Na—Sc iodide fill with precise amounts of zinc iodide ($ZnI_2$) added to replace the mercury. The bulb dimensions can substantially remain the same as the present D2 size lamp (inner diameter about 2.7 millimeter, body outer diameter about 6 millimeter, and inner length about 7.2 millimeter) with an arc gap between electrode tips of 4.2 millimeter nominally. The Na:Sc molar ratio is in the range of 4:1 to 6:1 with preferred ratios of 4:5:1 and 6:1. Lowering the molar ratio leads to increase lumens but causes accelerated wall reactions and reduced maintenance. Increasing the molar ratio reduces the wall reaction rate, but shifts color and reduces lumens.

The amount of salt in the lamp must be kept low to prevent creeping of the molten condensate up the inner surface of the lamp and interfering with the optical line-of-sight to the bright arc within the vessel as discussed by Kaneko et al. in EP 1 172 840 A2. Thin films of salt also can absorb light and lead to undesirable color shifts in the lamp. The preferred Na—Sc iodide salt dose is within the range of 0.2 to 0.25 mg in a quartz vessel of approximately 25 $mm^3$ volume.

For the D2 size lamp, zinc iodide ($ZnI_2$) is dosed in the amount between 0.05 to 0.15 mg, with the preferred amount being 0.1 mg. In general, the zinc iodide ($ZnI_2$) is dosed at 2 to 6 micrograms per cubic millimeter. An inert gas, such as xenon, is dosed into the lamp such that the fill pressure at room temperature is between 0.6 to 1.22 megapascal.

In the present invention, the electrodes are doped typically with between 0.5 to 2.0 weight percent of $ThO_2$. The preferred level is about 1% by weight. Pure tungsten electrodes could be used.

Figure 2:
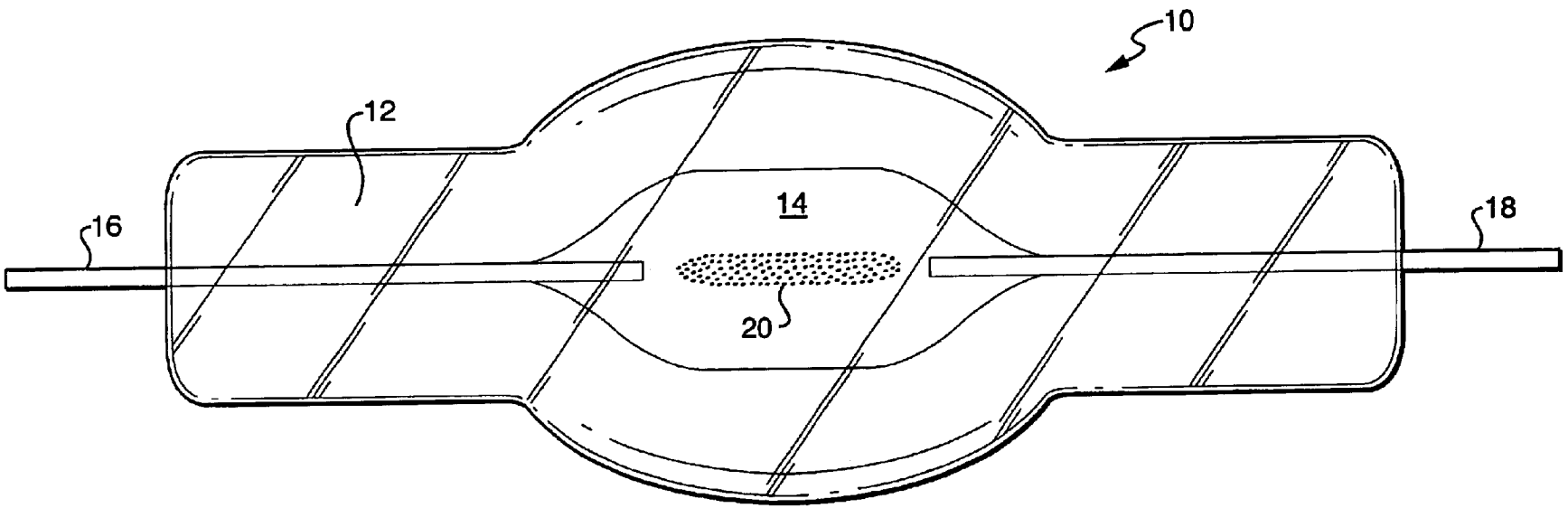
FIG. 2 is a pictorial representation of a lamp of the present invention.

In a preferred embodiment, shown in FIG. 2, the discharge lamp 10 is made from fused silica and has the following components:

a light transmissive quartz envelope 12 defining an enclosed volume 14 of between 18 to 42 cubic millimeters;

a first tungsten electrode 16 extending through the envelope 12 in a sealed fashion to contact the enclosed volume 14;

a second tungsten electrode 18 extending through the envelope 12 in a sealed fashion to contact the enclosed volume 14, where the tungsten electrode 16, 18 diameters are between 0.20 to 0.40 millimeter; and a fill material 20 positioned in the enclosed volume, where the fill material includes zinc iodide; sodium iodide; scandium iodide, and an inert fill gas, but does not include mercury or mercury compounds;

where the zinc iodide has a concentration in the enclosed volume ranging from 2 to 6 micrograms per cubic millimeter, with 3 to 4 micrograms per cubic millimeter being preferred;

where the sodium iodide has a concentration in the enclosed volume ranging from 5.0 to 5.7 micrograms per cubic millimeter;

where the scandium iodide has a concentration in the enclosed volume ranging from 2.7 to 3.3 micrograms per cubic millimeter; and where the inert fill gas (preferably xenon) has a cold (ambient) fill pressure in the enclosed volume ranging from 0.6 to 1.22 megapascals.

Figure 1:
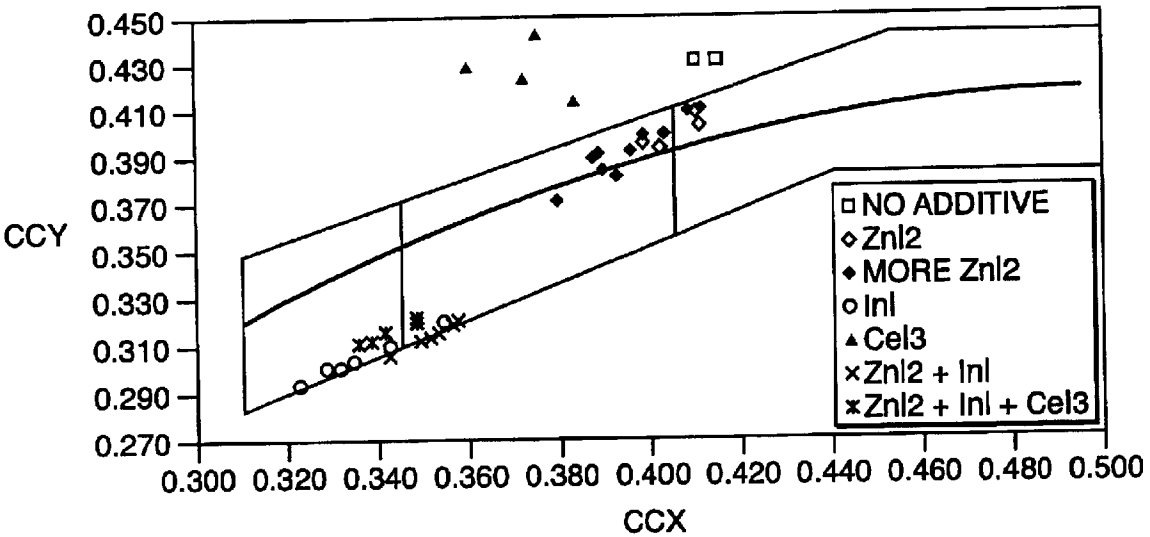
FIG. 1 is a graph showing the effect of metal iodides on the color coordinates (CCX, CCY) of a mercury free rare earth chemistry. The polygon represents the boundary of SAE white.
Figure 3:
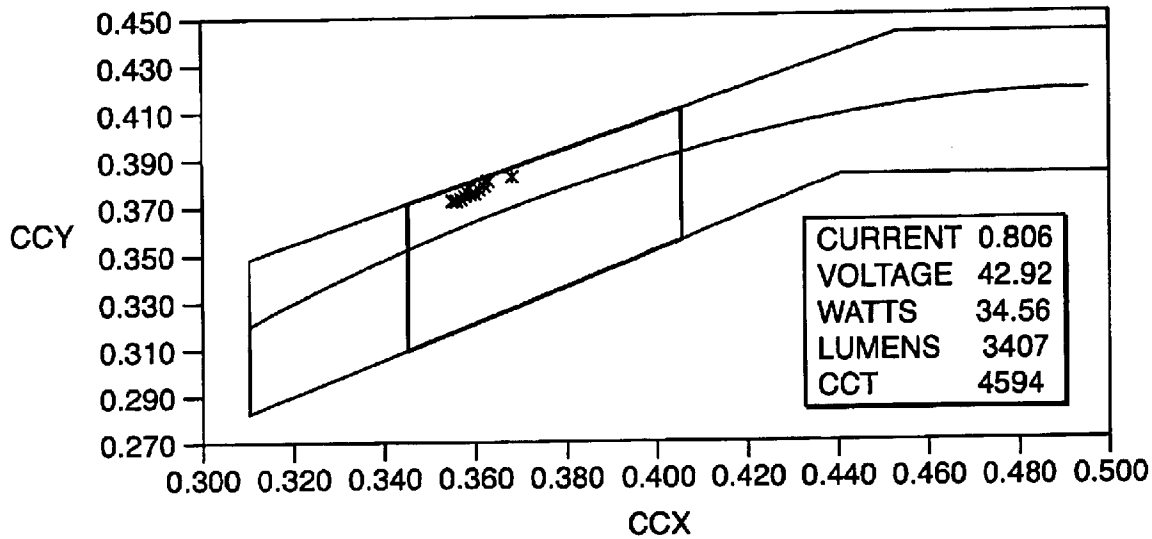
FIG. 3 is a graph showing the spectral comparison of an embodiment of the present invention and standard automotive lamp chemistry with mercury.
Figure 4:
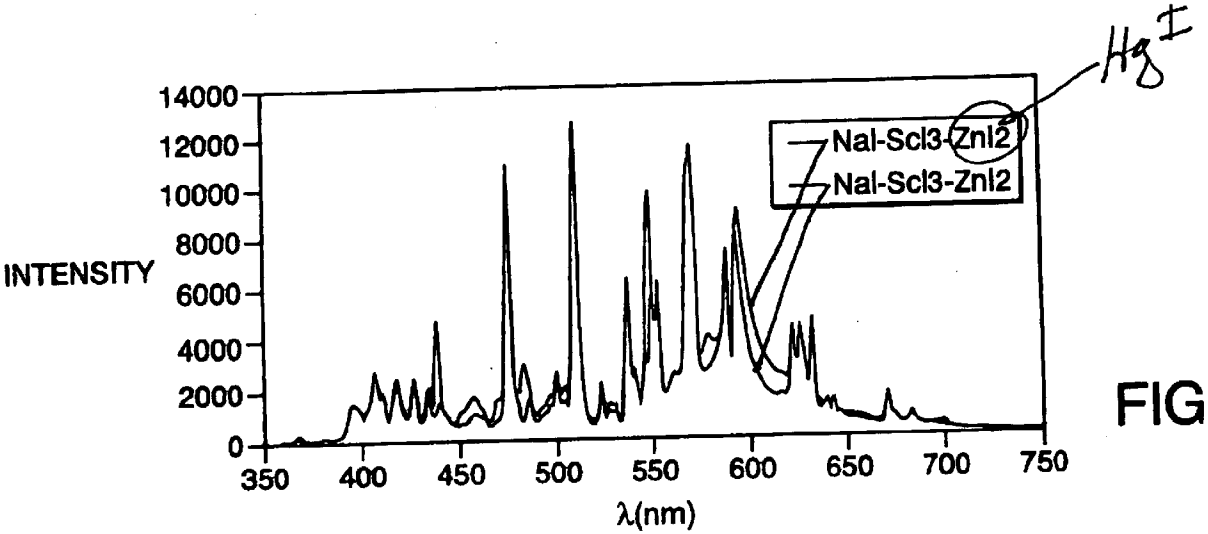
FIG. 4 is a graph showing data from sample run of an embodiment of the present invention. Note that the color coordinates are within the Regulation 99 requirements.

It is not apparent that NaI—$ScI_3$—$ZnI_2$ chemistries would be the preferred embodiment for mercury free automotive HID lamps. FIG. 3 shows data from sample runs of the current lamp embodiment. Surprisingly, the spectral output (NaI—$ScI_3$—$ZnI_2$) is nearly identical to mercury containing lamps (NaI—$ScI_3$—Hg) (FIG. 4) and the color coordinates, while shifted from the nominal positions, still fall within the restrictive requirements of Regulation 99 (FIG. 3), where the color coordinates are all seen to be within the polygon defining the Regulation 99 requirement. The ability to satisfy the stringent color point requirements is a unique and unanticipated feature of the present invention. For example, rare earth mercury free complexes may have higher CRIs, but also show variable CCTs, and displaced color point relative to NaI—$ScI_3$—$ZnI_2$ chemistries.

The NaI—$ScI_3$—$ZnI_2$ chemistries tend to allow the lamp to run cooler and the voltage rise over life appears to be smaller than with the rare earth complexes and it can be less reactive than the rare earth complex chemistries that have been examined. However, while constricting chemistries tend to increase lumen output, they also tend to be more chemically aggressive, bow more and may be prone to instability.

The inventors' experiments show that the voltage in mercury free HID lamps can be adjusted to reach 85 volts, the nominal operating voltage for mercury containing lamps. However, the increase in voltage is achieved with a corresponding decrease in lumen output. This is primarily due to the increased thermal conductivity of the pure zinc iodide ($ZnI_2$) vapor compared to mercury. The high thermal conductivity cools the arc core which reduces the radiative efficiency, W. P. Lapatovich and J. A. Baglio, *Chemical Complexing and Effects on Metal Halide Lamp Performance*, Paper 026:I, 9$^{th}$ International Symposium on the Science and Technology of Light Sources, Cornell University, Ithaca, N.Y., Aug. 12–16, 2001. This heat is transported to the walls of the arc lamp and causes the mercury free lamps to run hotter than the mercury containing counterparts at the same power level.

Figure 5:
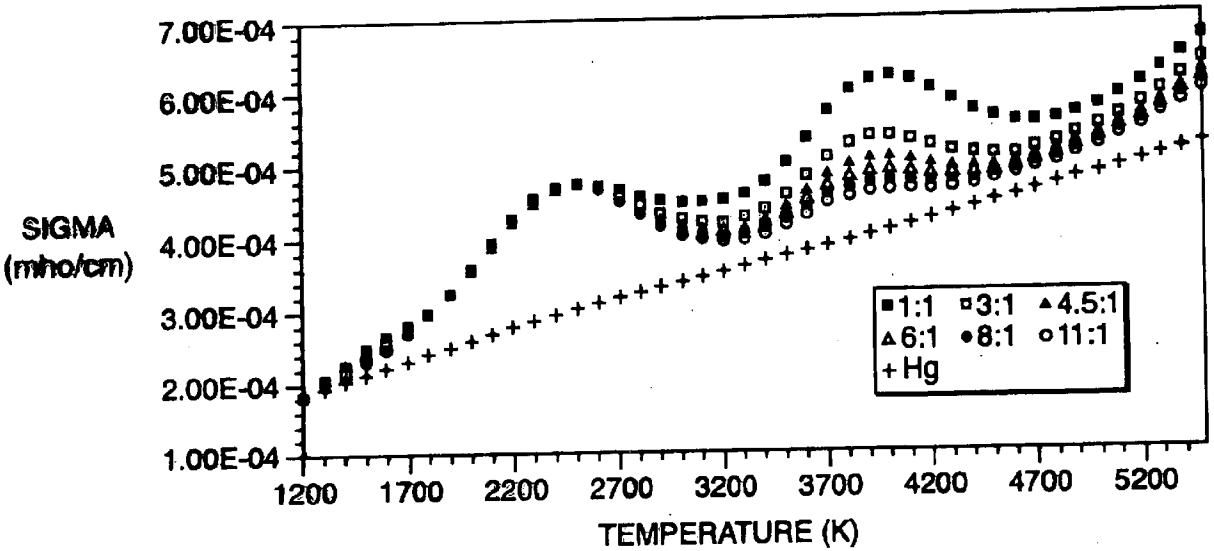
FIG. 5 is a graph showing the thermal conductivity of a series of mercury free NaI—$ScI_3$ ratios with zinc iodide ($ZnI_2$)
Figure 6:
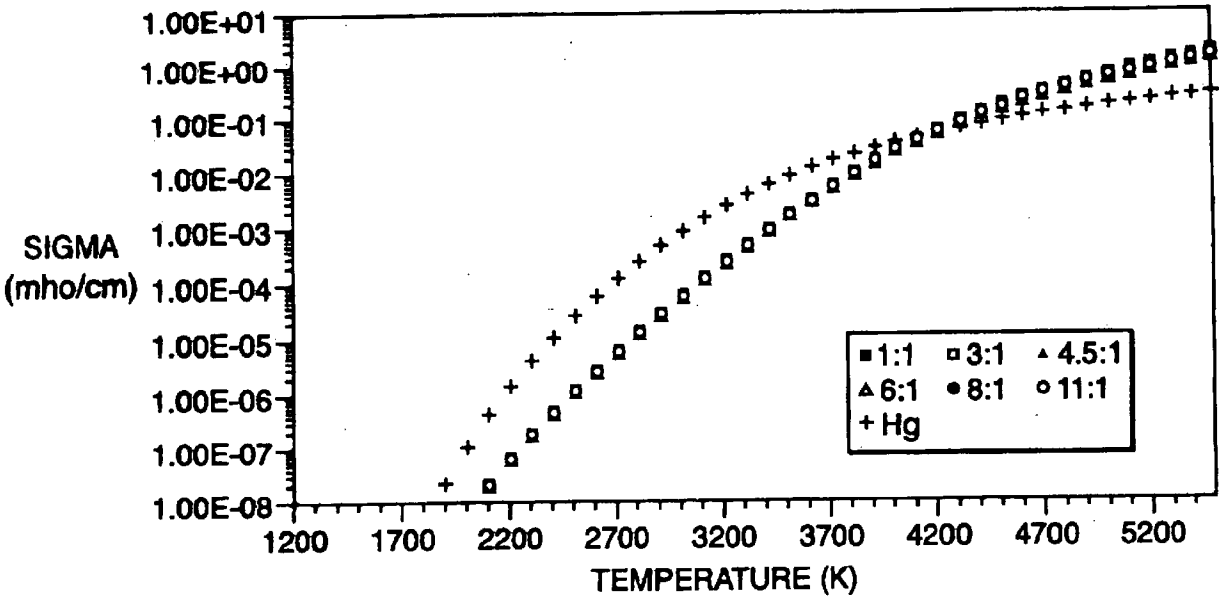
FIG. 6 is a graph showing the electrical conductivity of a series of mercury free NaI—$ScI_3$ ratios with zinc iodide ($ZnI_2$).

FIGS. 5 and 6 show comparisons of the calculated thermal and electrical conductivity of mercury free NaI—$ScI_3$—$ZnI_2$ and the standard chemistry with mercury. FIG. 5 shows the thermal conductivity of a series of mercury free sodium iodide scandium iodide ratios with zinc iodide. In FIG. 5, note the small dip from 3000 to 3500° K and that thermal conductivity at the arc core temperatures is significantly higher for the zinc iodide ($ZnI_2$) chemistries. FIG. 6 shows the electrical conductivity of a series of mercury free sodium iodide scandium iodide ratios with zinc iodide. FIG. 6 shows an order of magnitude increase in the electrical conductivity at the arc core temperature of the mercury free NaI—$ScI_3$—$ZnI_2$ chemistries relative to the standard chemistry with mercury. This manifests itself as a lower operating voltage.

The inventors have discovered that the zinc iodide cools the arc, and this generally reduces the number of lumens produced. A controlled amount of zinc iodide is therefore needed to get the correct voltage while still maintaining the number of lumens needed. With no zinc iodide the lamp has an operating voltage of 25 or 30 volts. The D2 size lamp voltage rapidly rises to about 95 volts with about 0.4 micrograms of zinc iodide.

Since automotive HID lamps are optical sources, the position, shape and stability of the arc are very important.

A typical D2S arc is well stabilized but not "fluffy". This is the arc presentation automotive lamp makers expect. In a mercury lamp, changing from a NaI—$ScI_3$ chemistry to a rare earth complex chemistry causes the arc to be fatter. Removing mercury may still provide an acceptable arc presentation but arc luminance, lumens, color and arc stability over the life of the lamp are equally important and it is here that such mercury free lamps fall short of requirements.

Figure 7:
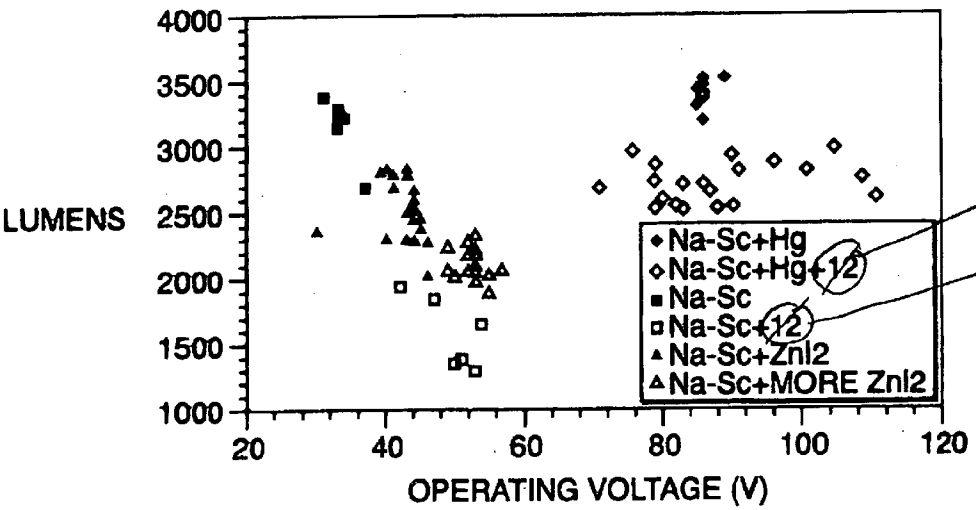
FIG. 7 is a graph showing the effects of additives on the voltage and lumens of NaI—$ScI_3$.
Figure 8:
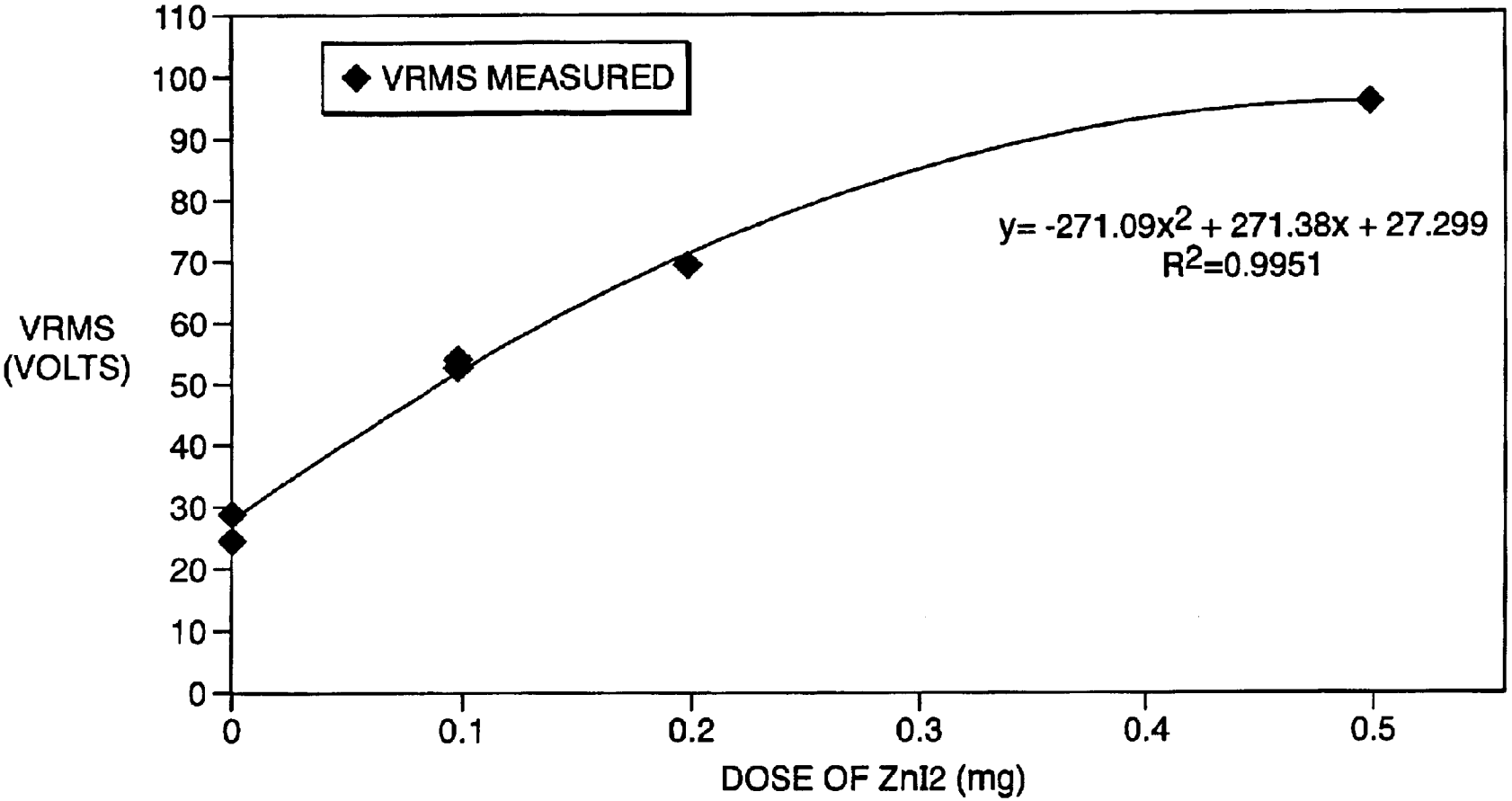
FIG. 8 is a graph showing a relationship between zinc iodide ($ZnI_2$) dose and voltage (rms) in a lamp of the present invention.

FIG. 7 shows the effects of additives on the voltage and lumens of $NaIScI_3$. The effect of adding zinc iodide ($ZnI_2$) to mercury free NaI—$ScI_3$ chemistries is not only to increase the operating voltage, but also to reduce the efficacy of the lamps as shown in FIG. 7. Here one sees the approximately 60 volt reduction in operating voltage by removing mercury. The effect of zinc iodide ($ZnI_2$) is to increase voltage but at the expense of light output, and thus the particular range of zinc iodide ($ZnI_2$) of the present invention assumes particular importance. This is partially due to radiation from the Zn in unwanted spectral regions and partially due to the reduced core temperature as discussed above. The effect of the dose of zinc iodide ($ZnI_2$) on the voltage for a D2 size lamp is shown in FIG. 8. Test lamps operated at 500 Hz switched DC confirm the acceptability of the lamp of the present invention.

Other easily vaporized salts could be used to enhance voltage, for example, TlI, Cd and Sb halides, etc.) but are contrary to an object of the present invention which is to provide an environmentally friendly lamp.

Figure 9:
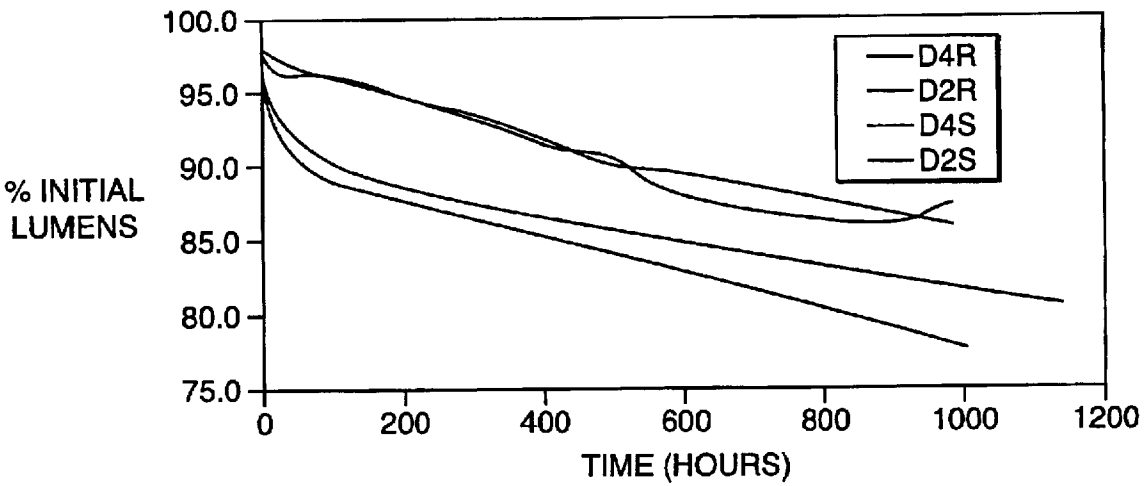
FIG. 9 is a graph showing lumen maintenance data for mercury free standard automotive lamp chemistry.
Figure 10:
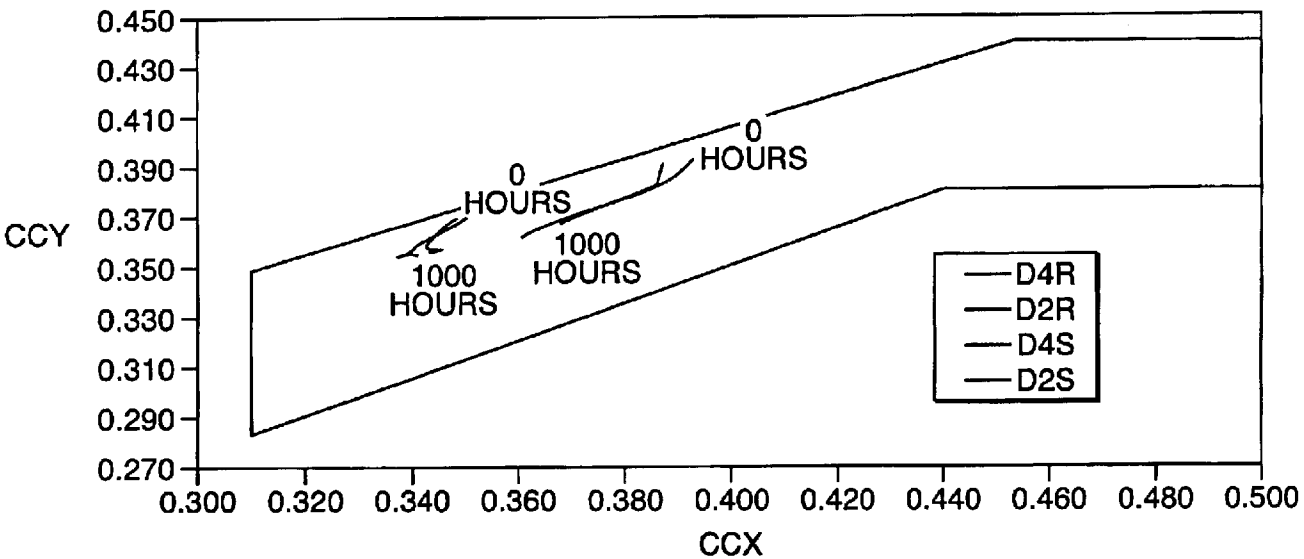
FIG. 10 is a graph showing color maintenance data for mercury free standard automotive lamp chemistry.

One advantage that NaI—$ScI_3$ chemistry enjoys over the rare earth complexes is the range of compositions available and the predictable performance of voltage enhancers across those ranges. FIG. 9 shows lumen maintanince for mercury free lamps with standard automotive chemistries. FIG. 10 shows color maintanince for mercury free lamps with standard automotive chemistries. Lumen maintenance of NaI—$ScI_3$ chemistries shows a favorable trend as seen in FIG. 9 and color maintenance as seen in FIG. 10. Many of the rare earth chemistry complexes exhibited rapid chemical reaction and inferior lumen maintenance.

Preliminary evaluation in both projector and reflector optics indicates that no major redesign of headlamps will be necessary for NaI—$ScI_3$—$ZnI_2$ mercury free chemistries. Tests have shown that the "hockey stick" cut-off requirement of Regulation 98 are met; while the glare requirements have been satisfied, one of the test points is below specification. Similar results have been observed with D4R and DOT compliant headlamps.

Based on the beam patterns it is clear that the optic need not be redesigned to accommodate the mercury free lamp, however, because of subtle changes in the arc geometry, headlamp optics can be adjusted to improve the candela at certain test points. Better beam patterns would thus be achievable than with a simple substitution into an existing optic.

One example of the lamp of the present invention is an arc discharge lamp with a sodium scandium iodide ($NaScI_4$) dopant with a sodium to scandium molar ratio of 6 to 1, in a cylindrical, pre-formed quartz envelope of pure quartz that has a volume of 25 $mm^3$. The fill includes 8 atmosphere (ambient temperature) of xenon. This may be a mixture of rare gases such as xenon and argon. The electrodes are tungsten rods, 0.01 inches in diameter with a standard electrode gap of 4.2 millimeters. No mercury is included in the lamp. About 0.1 to 0.4 mg of zinc iodide ($ZnI_2$) is included. This lamp provides 3000 lumens at 35 watts. The melt temperature is about 800 degrees Celsius. The added zinc iodide causes an increased thermal conductivity and hotter walls that may be offset with the inclusion of the argon.

A method of controlling the voltage of a mercury free metal halide lamp without substantial changing of the visible spectrum produced, includes the steps of:

providing a double ended quartz envelope defining an enclosed volume of 18 to 42 cubic millimeters;

sealing a first electrode through the quartz envelope and contacting the enclosed volume;

sealing a second electrode through the quartz envelope and contacting the enclosed volume;

providing an inert fill gas of xenon in the enclosed volume having a cold pressure of 0.6 to 1.22 megapascals;

providing a first fill component in the enclosed volume including sodium iodide with a concentration from 5.0 to 5.7 micrograms per cubic millimeter of the enclosed volume and scandium iodide with a concentration of from 2.7 to 3.3 micrograms per cubic millimeter of the enclosed volume, but not including mercury or a mercury halide otherwise resulting in a first visible spectrum having a first spectral integral from 350 to 800 nanometers; and adjusting a concentration of zinc iodide in the enclosed volume between 2 to 6 micrograms per cubic millimeter of the enclosed lamp so that the lamp voltage correspondingly varies between 42 and 85 volts and provides a second visible spectrum having a spectral integral from 350 nanometers to 800 nanometers not different from the first spectral integral by more than five percent of the first spectral integral.

The spectra are compared by integrating the square of their absolute difference over the visible range (approximately 350 to 800 nanometers). This is divided by the integral of undoped spectra to form a percent difference measurement. If there is zero percent difference, the spectra are the same. If there is a small difference in the spectra, then the percent difference is only a few percent. If the spectra are substantially different, then the percent difference is large.

While embodiments of the present invention have been described in the foregoing specification and drawings, it is to be understood that the present invention is defined by the following claims when read in light of the specification and drawings.

We claim:

1. An automotive mercury free discharge lamp, for use as a 35 watt automotive headlamp comprising:

a double ended quartz envelope defining an enclosed volume of 18 to 42 cubic millimeters;

a first electrode sealed through the quartz envelope and contacting the enclosed volume;

a second electrode sealed through the quartz envelope and contacting the enclosed volume;

an inert fill gas in the enclosed volume having a cold pressure of 0.6 to 1.22 megapascals; and a fill component in the enclosed volume that includes a metal halide and zinc iodide, the zinc iodide having a concentration of 2 to 6 micrograms per cubic millimeter of the enclosed volume, the enclosed volume not having either mercury or a mercury halide therein.

2. The lamp of claim 1, wherein the concentration of zinc iodide is 3 to 4 micrograms per cubic millimeter of the enclosed volume.

3. The lamp of claim 1, wherein the fill comprises sodium iodide with a concentration of 5 to 5.7 micrograms per cubic millimeter of the enclosed volume.

4. The lamp of claim 1, wherein the fill comprises scandium iodide with a concentration of 2.7 to 3.3 micrograms per cubic millimeter of the enclosed volume.

5. The lamp of claim 1, wherein the inert fill gas comprises xenon.

6. The lamp of claim 1, wherein the fill comprises sodium iodide (NaI) and scandium iodide ($ScI_3$) and the zinc iodide is $ZnI_2$.

7. An automotive mercury free discharge lamp for use as a 35 watt automotive headlamp for operation at approximately 42 volts AC, comprising:

a double ended quartz envelope defining an enclosed volume of 18 to 42 cubic millimeters, the enclosed volumes containing neither mercury nor a mercury halide;

a first electrode sealed through the quartz envelope and contacting the enclosed volume;

a second electrode sealed through the quartz envelope and contacting the enclosed volume;

a xenon fill gas in the enclosed volume having a cold pressure of 0.6 to 1.22 megapascals;

a first fill component in the enclosed volume including sodium iodide with a concentration of from 5.0 to 5.7 micrograms per cubic millimeter and scandium iodide with a concentration of from 2.7 to 3.3 micrograms per cubic millimeter; and a second fill component in the enclosed volume including zinc iodide with a concentration of 2 to 6 micrograms per cubic millimeter.

* * * * *